US005803718A

United States Patent [19]

Woo

[11] Patent Number: 5,803,718

[45] Date of Patent: Sep. 8, 1998

[54] OIL SUPPLYING APPARATUS FOR HERMETIC TYPE COMPRESSOR

[75] Inventor: Jin Hyun Woo, Kyungsangnam-Do, Rep. of Korea

[73] Assignee: LG Electronics Inc., Rep. of Korea

[21] Appl. No.: 583,440

[22] Filed: Jan. 5, 1996

[30] Foreign Application Priority Data

Apr. 3, 1995 [KR] Rep. of Korea ..... 1995/7726

[51] Int. Cl.[6] ..... F04B 39/02

[52] U.S. Cl. ..... 417/372; 184/6.16; 184/6.18

[58] Field of Search ..... 417/372; 184/6.16, 184/6.18, 63; 415/88; 60/39.32

[56] References Cited

U.S. PATENT DOCUMENTS 2,581,999 1/1952 Blatz ..... 60/39.32

FOREIGN PATENT DOCUMENTS 62-168933 7/1987 Japan ..... 60/39.32

763692 12/1956 United Kingdom ..... 60/39.32

*Primary Examiner*—Timothy Thorpe
*Assistant Examiner*—Cheryl J. Tyler
*Attorney, Agent, or Firm*—Ostrolenk, Faber, Gerb & Soffen, LLP

[57] ABSTRACT

An improved oil supplying apparatus for a hermetic type compressor capable of preventing a burr formation due to scratches caused between an outer sharp edge portion of a propeller and the inner surface of a casing when the propeller is inserted into the casing by providing protrusions at both ends of upper and intermediate support blades of the propeller, which includes a crank shaft having an outer guide groove formed on an outer surface thereof and an inner guide groove formed on an inner portion thereof; a casing connected to the lower portion of a lower portion of the inner guide groove of the crank shaft; and an oil supplying unit having an oil supplying unit, a supporting unit, and a scratch prevention unit, the oil supplying unit, the supporting unit, and the scratch prevention unit being disposed within the casing.

8 Claims, 3 Drawing Sheets

OIL SUPPLYING APPARATUS FOR HERMETIC TYPE COMPRESSOR

BACKGROUND OF THE INVENTION

1. Field of the Invention

The present invention relates to an oil supplying apparatus for a hermetic type compressor, and particularly to an improved oil supplying apparatus for a hermetic type compressor capable of preventing a burr formation due to scratches caused between an outer sharp edge portion of a propeller and the inner surface of a casing when the propeller is inserted into the casing by providing protrusions at both ends of upper and intermediate support blades of the propeller.

2. Description of the Conventional Art

FIG. 1 shows a conventional hermetic type compressor, which includes an upper shell 1 and a lower shell 2. A hermetic space 14 is formed within the upper shell 1 and the lower shell 2. A frame 3 is disposed at a central portion of the hermetic space 14. A motor unit 15 is disposed below the frame 3. A compressor unit 16 is disposed at the upper portion of the frame 3.

The motor unit 15 includes a rotor 4 passing through the center portion of the frame 3 and receiving a crank shaft 6 rotatably inserted through the center portion thereof, and a stator 5 spaced apart from the rotor 4 by a predetermined distance for rotating the rotor 4 in cooperation with an electric relationship therebetween.

Meanwhile, the compressor unit 16 includes a cylinder 7 fixed to the upper surface of the frame 3, a crank unit 9 for converting the rotation movement of the crank shaft 6 into a linearly reciprocating movement, and a piston 8 linearly reciprocating within the cylinder 7 for compressing a refrigerant gas.

Meanwhile, an outer groove 6*b* is formed at an outer surface of the crank shaft 6*a,* and an inner guide groove 6 is formed within the crank shaft 6.

In addition, an oil supplying apparatus 20 is disposed below the inner guide groove 6*a*.

As shown in FIGS. 2A and 2B, the oil supplying apparatus includes a hollow cylindrical casing 21 fixed to the lower portion of the crank shaft 6 and rotating together with the rotation of the crank shaft 6, and a propeller 22 inserted into the casing 21 and rotating together with the casing 21 for propelling oil 11.

The construction of the propeller 22 of the conventional oil supplying apparatus will now be explained.

A pair of opposing upper support blades 22*b* are disposed at the upper side of the casing 21 for restricting the movement of the propeller 22.

In addition, a pair of opposing intermediate support blades 22*c* are disposed at the intermediate side of the casing 21 for restricting the movement of the propeller 22.

In addition, a pair of fork-shaped opposing lower support blades 22*d* are disposed at the lower side of the body 22*a*.

In the drawings, character reference "d" denotes the distance between the intermediate support blades 22*c*.

The operation of the conventional oil supplying apparatus 20 of the hermetic type compressor will now be explained with reference to the accompanying drawings.

To begin with, the conventional oil supplying apparatus 20 rotates together with the crank shaft 6.

Therefore, the oil 11 stored in the lower shell 2 is pumped toward the upper side of the compressor in cooperation with the centrifugal force caused by the rotation of the crank shaft 6 and the pumping force caused by the rotation of the lower blade 22*d*.

Therefore, the oil 11 is supplied toward the friction portions of the elements of the motor unit 15 and the compressor unit 16 along the inner guide groove 6*a* and the outer guide groove of the crank shaft 6.

Meanwhile, the diameter of both the upper support blades 22*b* and the intermediate support blades 22*c* of the oil supplying apparatus 20 is larger than the inner diameter of the casing 21. This reason is to prevent the propeller 22 from deviating from the casing 21 by the rotation of the oil supplying apparatus 20 so that both ends of the upper support blades 22*b* and the intermediate support blades 22*c* come into elastic contact with the inner wall of the casing when assembling the propeller 22 into the interior of the casing 21.

Therefore, the conventional oil supplying apparatus of the hermetic type compressor has disadvantages in that when the propeller 22 is inserted into the casing 21, the outer sharp edge portions of the intermediate support blades 22*c* scratch the inner wall surface of the casing, thus producing burrs therein.

In addition, the thusly formed burrs are introduced into the friction portion of the motor unit 15 and the compressor unit 16 together with the oil 11 along the inner guide groove 6*a* and the outer guide groove 6*b* of the crank shaft 6 of the oil supplying apparatus when the oil 11 is pumped to the friction portion thereof, thus causing the stop of operation of the system and the clog of an oil flowing path of the system due to the burrs.

In addition, when inserting the propeller 22 into the casing 21, the upper support blades 22*b* and the intermediate support blades 22*c* of the propeller 22 come into tight contact with the inner surface of the casing 21, so that physical variation of the propeller 22 may occur, thus deteriorating the performance of the propeller.

SUMMARY OF THE INVENTION

Accordingly, it is an object of the present invention to provide an oil supplying apparatus for a hermetic type compressor, which overcome the problems encountered in a conventional oil supplying apparatus for a hermetic type compressor.

It is another object of the present invention to provide an improved oil supplying apparatus for a hermetic type compressor capable of preventing a burr formation due to scratch caused between an outer sharp edge portion of a propeller and the inner surface of a casing when the propeller is inserted into the casing by providing protrusions at both ends of upper and intermediate support blades of the propeller.

To achieve the above objects, there is provided an oil supplying apparatus for a hermetic type compressor, which includes a crank shaft having an outer guide groove formed on an outer surface thereof and an inner guide groove formed on an inner portion thereof; a casing connected to the lower portion of a lower portion of the inner guide groove of the crank shaft; and an oil supplying unit having an oil supplying unit, a supporting unit, and a scratch prevention unit, the oil supplying unit, the supporting unit, and the scratch prevention unit being disposed within the casing.

DETAILED DESCRIPTION OF THE INVENTION

Figure 1:
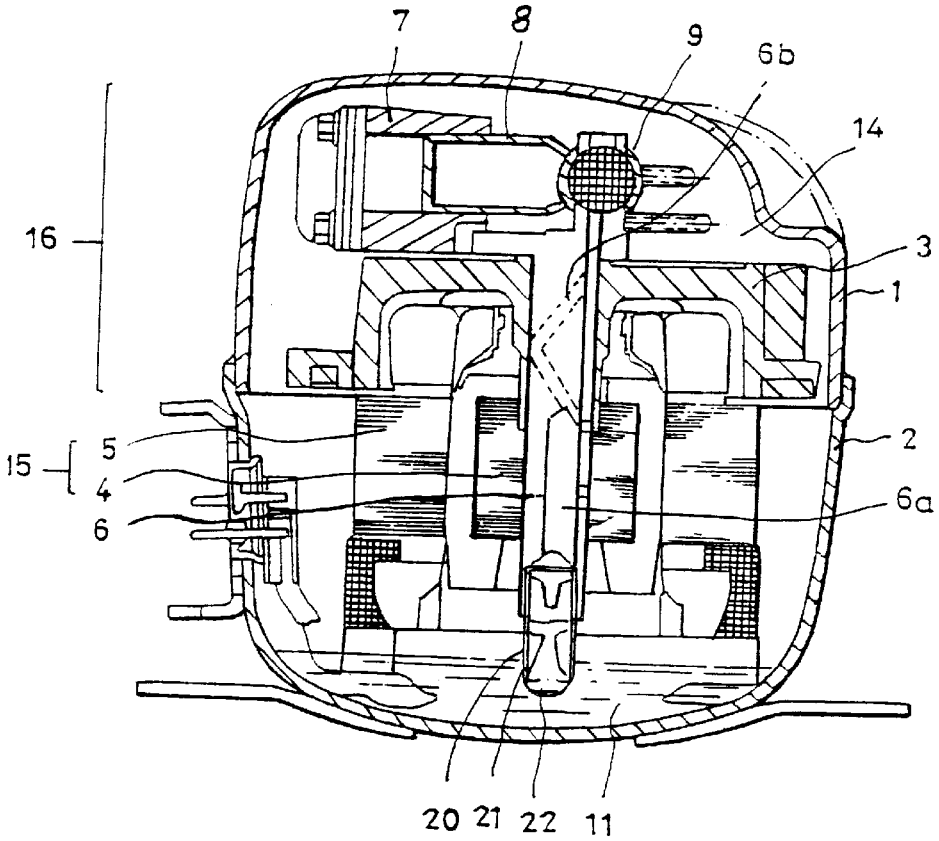
FIG. 1 PRIOR ART
FIG. 1 is a cross-sectional view of a conventional hermetic type compressor.
Figure 2A:
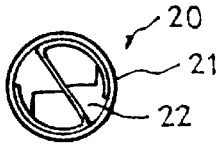
FIG. 2A PRIOR ART
FIG. 2A is a plan view showing a conventional oil supplying apparatus.
Figure 2B:
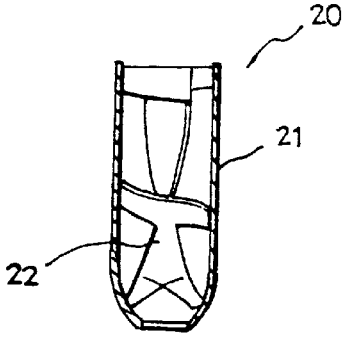
FIG. 2B PRIOR ART
FIG. 2B is a perspective view partially showing an internal construction of a conventional oil supplying apparatus.
Figure 3A:
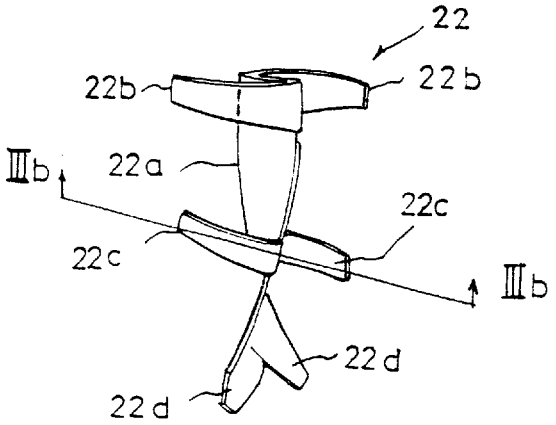
FIG. 3A PRIOR ART
FIG. 3A is a perspective view of a propeller of a conventional oil supplying apparatus.
Figure 3B:
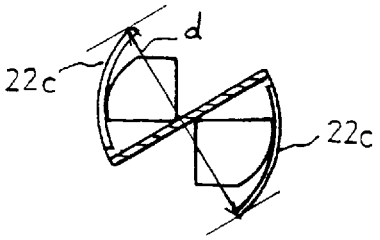
FIG. 3B PRIOR ART
FIG. 3B is a cross-sectional view taken along line IIIb—IIIb of FIG. 3A.
Figure 4A:
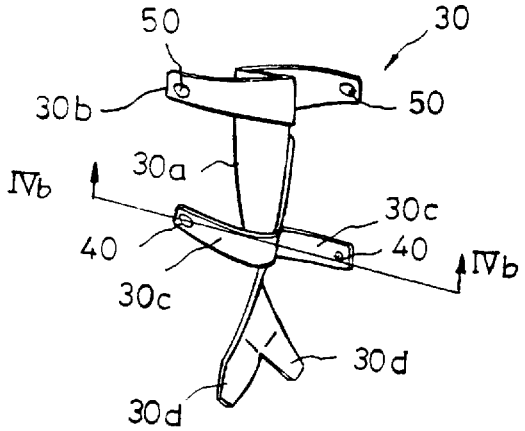
FIG. 4A is a perspective view of a propeller of an oil supplying apparatus of a hermetic type compressor according to the present invention.
Figure 4B:
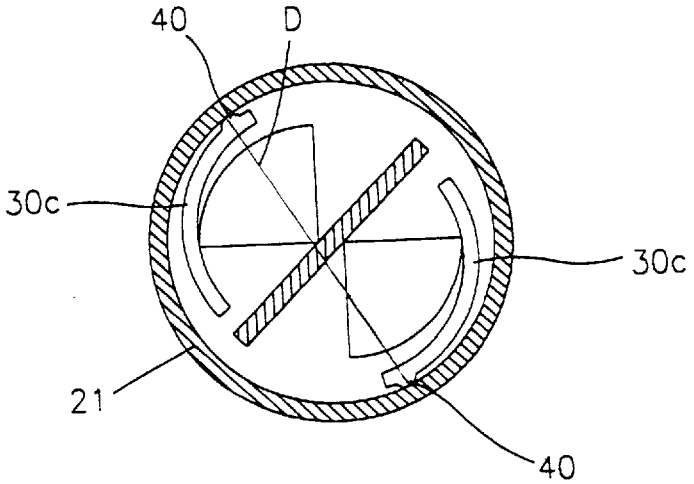
FIG. 4B is a cross-sectional view taken along line IVb—IVb of FIG. 4A according to the present invention.
Figure 4C:
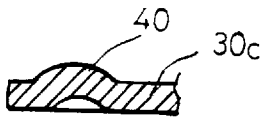
FIG. 4C is a cross-sectional view of a protrusion of an intermediate blade of a propeller of an oil supplying apparatus for a hermetic type compressor according to the present invention.

FIGS. 4A and 4C show a propeller of an oil supplying apparatus of the present invention.

As shown therein, a pair of twisted and opposing upper support blades 30*b* formed at the upper portion of a body 30*a* of the propeller 30 are inserted into a casing 21 and positioned at the upper side of the casing 21 for restricting the movement of the propeller 30.

In addition, a pair of twisted and opposing intermediate support blades 30*c* formed at the intermediate portion of the body 30*a* of the propeller 30 are positioned at the intermediate side of the casing 21 for restricting the movement of the propeller 30.

In addition, a pair of fork-shaped and opposing lower support blades 30*d* formed at the lower portion of the body 30*a* of the propeller 30 are positioned at the lower side of the casing 21 for restricting the movement of the propeller 30.

Protrusions 50 and 40 formed at edge portions of the upper support blades 30*b* and the intermediate support blades 30*c* contact with the inner wall of the casing 21. The outer portion of the protrusions 50 and 40 are rounded. That is, since the rounded outer portions of the protrusions 50 and 40 softly contact with the inner surface of the casing 21, it is possible to effectively prevent a burr formation, as compared to the prior art, by preventing the sharp edge portion of the propeller 30 from directly contacting with the inner surface of the casing 21.

In addition, since the rounded portion of the upper and intermediate blades 30*b* and 30*c* contact with the inner wall of the casing 21, it is possible to prevent friction force between the upper and intermediate blades 30*b* and 30*c* and the inner surface of the casing 21.

Meanwhile, the distance "D" between the protrusions 40 of the intermediate support blades 30*c* is slightly larger than the inner diameter of the casing 21, and the distance between the protrusions 50 of the upper support blades 30*b* is slightly larger that the inner diameter of the casing 21, so that the propeller 30 is not deviated from the casing 21 by the rotation force of the propeller 30 because the protrusions 50 and 40 of the upper support blades 30*b* and the intermediate support blades 30*c* come into elastic contact with the inner wall of the casing 21.

In addition, when viewing the upper support blades 30*b* and the intermediate support blades 30*c* from the top portion thereof, they have an elliptical section having a shortest diameter larger than that of the casing 21.

Therefore, when inserting the propeller 30 into the hollow cylindrical casing 21, the upper support blades 30*b* and the intermediate support blades 30*c* come into elastic contact with the inner surface of the casing 21, so that the propeller 30 can have a certain tight contact with the casing, thus preventing the propeller 30 from deviating from the casing 21.

In the drawings, character reference "D" denotes the distance between the intermediate support blades 30*c*.

When inserting the propeller 30 into the casing 21, the distance "D" between the intermediate support blades 30*b* of the propeller 30 becomes shorter than the inner diameter of the casing, so that elastic contacts between the upper support blades 30*b* and the intermediate support blades 30*c* can be achieved.

Here, the rounded protrusions 50 and 40 formed at the outermost edge portions of the upper support blades 30*b* and the intermediate support blades 30*c* come into elastic contact with the inner surface of the casing 21, so that it is possible to prevent any scratches between the upper support blades 30*b* and the intermediate support blades 30*c*, thus preventing a burr formation therein.

As described above, the oil supplying apparatus for a hermetic type compressor is directed to providing a propeller having upper support blades, intermediate support blades each having rounded protrusions formed on the outermost edge portions thereof, so that it is possible to prevent any scratches between the upper support blades 30*b* and the intermediate support blades 30*c*, thus preventing a burr formation therein. In addition, friction force is reduced between the upper support blades and intermediate support blades and the inner surface of the casing because the rounded protrusions thereof come into soft contact with the inner surface of the casing. In addition, it is possible to prevent any variation of the propeller, thus accurately controlling the oil supply to friction portions of the compressor unit.

Moreover, since there is no burr formation in the system and the burrs are not supplied to the friction portion of the system together with the oil, the reliability of the product can be increased.

Furthermore, since the rounded protrusions are formed on the outermost edge portion of the upper support blades and the intermediate support blades, it is possible to more easily insert the propeller into the casing, thus increasing working efficiency.

Although the preferred embodiments of the present invention have been disclosed for illustrative purposes, those skilled in the art will appreciate that various modifications, additions and substitutions are possible, without departing from the scope and spirit of the invention as described in the accompanying claims.

What is claimed is:

1. An oil supplying apparatus for a hermetic type compressor, comprising:

a crank shaft having an outer guide groove formed on an outer surface thereof and an inner guide groove formed on an inner portion thereof;

a casing connected to the lower portion of a lower portion of said inner guide groove of said crank shaft; and oil supplying means having an oil supply unit for supplying oil into the casing, a supporting unit engaging an inner surface of the casing, and having at least one pair of blades and protrusions formed on a radially outer surface of the at least one pair of blades, the protrusions serving to prevent scratching of the inner surface of the casing by the at least one pair of blades, said oil supply unit, said supporting unit, and said protrusions being disposed within said casing.

2. The apparatus of claim 1, wherein said oil supplying unit comprises a pair of fork-shaped lower support blades.

3. The apparatus of claim 1, wherein said supporting unit includes a pair of opposing upper support blades and a pair of opposing intermediate support blades, wherein the cross sections of said upper support blades and said intermediate support blades are elliptical when the upper support blades and the intermediate support blades are not inside the casing.

4. The apparatus of claim 3, wherein said protrusions are respectively formed at an outermost edge portion of the upper and intermediate support blades of the supporting unit.

5. The apparatus of claim 1, wherein said protrusions are located between the oil supplying unit and the inner surface of the casing.

6. The apparatus of claim 1, wherein said oil supplying means is elastically supported to the inner surface of the casing.

7. The apparatus of claim 1, wherein said protrusions have rounded portions.

8. The apparatus of claim 1, wherein the distance between one of said protrusions and an oppositely located another one of said protrusions is larger than an inner diameter of the casing.

* * * * *